United States Patent [19]

Yamazaki

[11] 4,005,507

[45] Feb. 1, 1977

[54] SAFETY PUSHPIN

[76] Inventor: Tadakatsu Yamazaki, No. 802, 1-10-22, Nakameguro, Meguro, Tokyo, Japan

[22] Filed: Oct. 23, 1974

[21] Appl. No.: 517,432

[30] Foreign Application Priority Data

Jan. 16, 1974 Japan ..... 49-7248[U]

[52] U.S. Cl. ..... 24/150 R; 85/16; 24/153 R; 24/156 R

[51] Int. Cl.[2] ..... A44B 9/00; A44C 5/18

[58] Field of Search ..... 24/85 R, 150 R, 150 C, 24/150 P, 154, 158 R, 158 S, 162, 153, 153.1, 252 AT, 252 LH, 252 DC, 252 CD, 265 B, 239, 230 AL; 85/16; 248/475 R, 316 D, 216

[56] References Cited

UNITED STATES PATENTS

| | | | |
|---|---|---|---|
| 526,746 | 10/1894 | Ruffner | 24/155 SD |
| 1,976,747 | 10/1934 | Reuter et al. | 85/16 |
| 3,538,558 | 11/1970 | Croft | 24/230 AL |
| 3,710,458 | 1/1973 | Bornor et al. | 24/265 B |

FOREIGN PATENTS OR APPLICATIONS

| | | | |
|---|---|---|---|
| 641,139 | 4/1928 | France | 85/16 |
| 332,556 | 10/1958 | Switzerland | 24/265 B |

*Primary Examiner*—Paul R. Gilliam
*Assistant Examiner*—V. N. Sakran
*Attorney, Agent, or Firm*—Zarley, McKee, Thomte & Voorhees

[57] ABSTRACT

A safety pushpin comprising a head and a pin extending from the center of said head, said pushpin being contained in a casing comprising an upper shell having at its top a large-diameter hole having an inwardly flanged opening edge and a lower shell having a small-diameter hole in the center of bottom wall thereof, said head of the pushpin having a diameter larger than the distance across said inwardly flanged edge, and the pin extending from the head of the pushpin being passable through said small-diameter hole, and further, a safety pushpin also servable as a clip, which has the substantially same construction as the above-said pushpin and in which an obliquely extending space spread out radially toward the upper and lower ends is provided at a suitable part in the joint of the casing and said both upper and lower shells are joined swingably so as to be able to close said obliquely extending space, and also an elastic member is interposed between said upper and lower shells so that said space is open normally.

9 Claims, 8 Drawing Figures

SAFETY PUSHPIN

This invention relates to a safety pushpin which, when not used, prevents perfectly the body of a person or other things from being injured or damaged by a pin of the pushpin because there is no danger that a person treads on or touches the pin.

This invention also relates to a safety pushpin which, in use, can serve as a clip holding paper or the like fast.

In the conventional pushpins, a pin of the pushpin remains bare and to stick out, therefore, the pin has a great danger of injuring the body of a person or damaging other things. Further, such conventional pushpins have the only function of mounting or holding paper or the like on a plate or non-metal wall.

The present invention provides a novel and technically remarkable pushpin which is free of the above mentioned defects which the conventional pushpins have.

The first object of the present invention is to provide a safety pushpin with a construction such that when it is not used, a pin of the pushpin is automatically retracted into a casing to eliminate any possibility that a person treads on or touches the pin, thus perfectly precluding a danger of injuring the body of a person or damaging other things.

The second object of the present invention is to provide a safety pushpin which, in use, serves to keep paper or the like clipped as well as to tack down paper or the like.

The third object of the present invention is to provide a safety pushpin which, when used as a clip, can be held fast to the surface of a magnetic material such as iron plate through which the pin can not be thrust.

The present invention is described in detail by way of embodiments thereof illustrated in the accompanying drawings, in which FIGS. 1 and 2 are longitudinal sectional views showing a safety pushpin according to one embodiment of the present invention;

Figure 1:
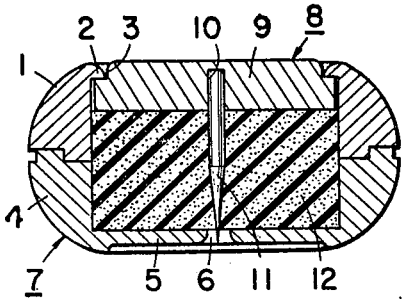
Figure 2:
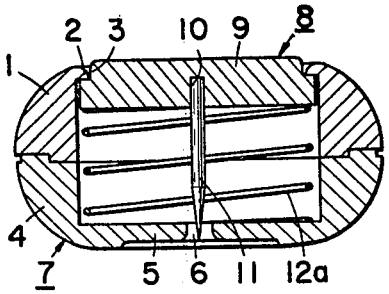
Figure 3:
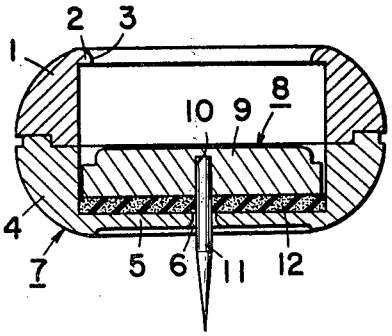
FIG. 3 is a longitudinal sectional view showing the safety pushpin of FIG. 1 in use.

Referring first FIGS. 1 to 3, there is shown a safety pushpin according to one embodiment of the present invention. This safety pushpin, generally indicated by numeral 8, has a head or base plate 9 designed to fit in the inside of a casing 7 comprising an upper shell 1 having at its top a large-diameter hole 3 having an inwardly flanged edge 2 at its opening and a lower shell 4 having a small-diameter hole 6 formed in the center of the bottom wall 5, said both shells being joined together by a suitable means. The head 9 of the pushpin 8 is larger in diameter than the distance across said inwardly flanged edge 2. A pin 11 fixed at its proximal end in a hole 10 provided in the center of said head 9 can pass through said hole 6 in said bottom wall 5.

It is desirable to interpose a suitable weak elastic material such as an urethane foam pad 12 shown in FIG. 1 or a coil spring 12*a* shown in FIG. 2 between the head 9 of the pushpin 8 and the bottom wall of the casing 7 so as to always give an upward pressing force to the pushpin 8 so that the upper edge of the head 9 pushes against and is withheld by the underside of the inwardly flanged edge 2 of the large-diameter hole 3 in the casing 7. However, such upper pressing force given by said elastic material should be such that it exerts no influence to the tacking action of the pushpin when it is used for tacking down paper or the like. The length of the pin 11 is determined such that it will not project out from the bottom wall 5 of the casing 7 when the head 9 of the pushpin 8 abuts against the underside of the inwardly flanged edge 2 of the casing 7.

In the embodiment shown in FIGS. 1 to 3, the casing 7 consists of the upper and lower shells 1 and 4 which are joined together by a suitable joining means, but the casing 7 may be formed from shells which are split sidewise.

In use of the safety pushpin shown FIGS. 1 to 3 described hereabove, a finger or the like is inserted into the large-diameter hole 3 in the casing 7 and pushes down the head 9 of the pushpin 8 to run the pin 11 into a desired spot. When the pushpin is not in use, if the casing 7 is in vertical or erect state, the pushpin 8 is kept housed within the casing 7 as the pointed end of the pin 11 touches lightly against the floor surface or the like, while in case that the casing 7 is lying on its side, the pushpin 8 also stays within the casing 7 owing to its own weight. Thus, there is perfectly no possibility that a person's finger or other parts of the body should touch the pointed end of the pin 11 and be injured.

If a suitable elastic body, such as afore-mentioned, is interposed between the head 9 of the pushpin 8 and the bottom wall 5 of the casing 7, positive retraction of the pushpin 8 into the casing 7 is even more ensured. Mounting of such elastic body permits the pushpin 8 to not only perform its normal tacking-down function but also to serve as a clip for holding paper or the like between the pushpin 8 and the surface of a plate or the like into which the pin is stuck. Such clipping of paper or the like is further secured if a non-slip is provided on the bottom surface of the casing 7.

FIGS. 4 to 8 show a safety pushpin according to another embodiment of the present invention. The safety pushpin according to this embodiment has not only the function of the embodiment shown in FIGS. 1 to 3 but also the function to clip paper or the like with more certainty. The embodiment shown in FIGS. 4 to 8 comprises a pushpin 28 having a head 29 and a casing 27 consisting of an upper shell 21 having at its top a large-diameter hole 23 having an inwardly flanged edge 22 at its opening and a lower shell 24 having a small-diameter hole 26 in the center of the bottom wall 25, said head 29 of the pushpin 28 being larger in diameter than the distance across said inwardly flanged edge 22 of the large-diameter hole 23. The pushpin 28 is housed within the casing 27 such that a pin 31 fixed at its proximal end in a hole 30 formed in the center of said head 29 may be passed through said hole 26. Also, an obliquely extending space 33 which is spread out radially toward both upper and lower ends is provided at a suitable part in the juncture 32 of the upper shell 21 and the lower shell 24, and an elastic material 34 is interposed between said upper and lower shells 21 and 24 so that said space 33 may be closed. The upper and lower shells 21 and 24 are joined swingable relative to each other, with said oblique space 33 being kept open normally.

At the juncture 32 of the upper shell 21 and the lower shell 24, there are provided a face 37 in the upper shell and a face 38 in the lower shell which are parallel to a top surface 35 of the upper shell and a bottom surface 36 of the lower shell, as well as a slanting faces 39 in the upper shell and 40 in the lower shell. At the boundary of said parallel faces 37 and 38, and said slanting faces 39 and 40, there are provided the lobes 41, 41 projecting from the underside of the upper shell 21, each of said lobes having provided a small protuberance 42 on its outside, while the corresponding recesses with holes 43, 43 for fitting said respective small protuberances 42, 42 are provided in the inside of the lower shell 24, whereby said protuberances 42, 42 fit in said corresponding holes 43, 43. Both upper and lower shells are swingable relative to each other so that the parallel face 37 of the upper shell meets the parallel face 38 of the lower shell whilst the slanting face 39 of the upper shell meets the counterpart 40 of the lower shell.

Figure 4:
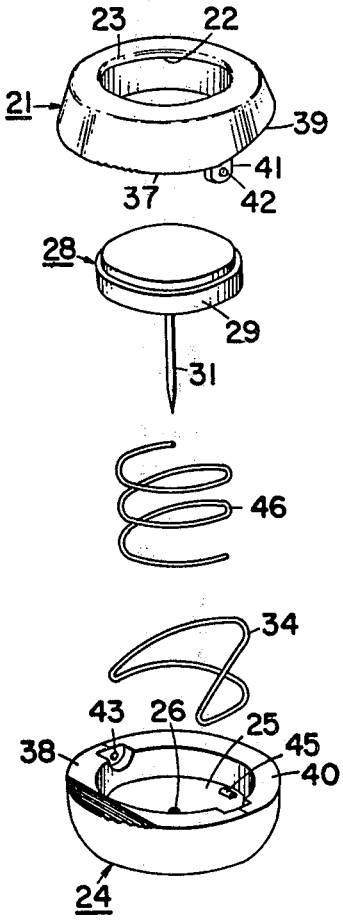
FIG. 4 is an exploded perspective view of a safety pushpin according to another embodiment of the present invention.
Figure 5:
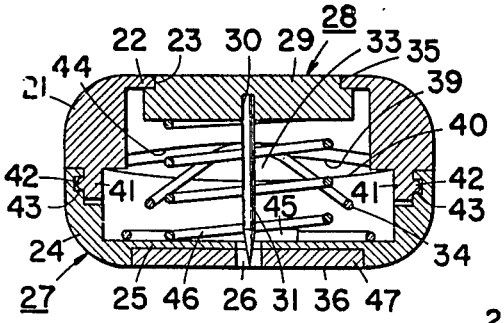
FIG. 5 is a central longitudinal sectional front view of the safety pushpin shown in FIG. 4.
Figure 6:
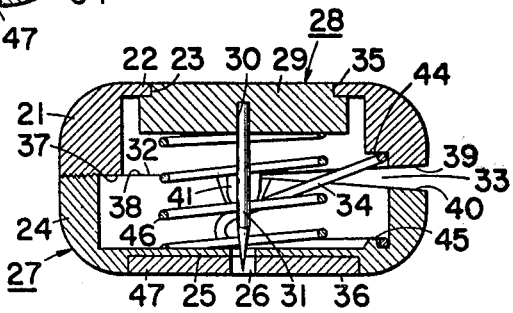
FIG. 6 is a sectional view taken at right angles to FIG. 5.
Figure 7:
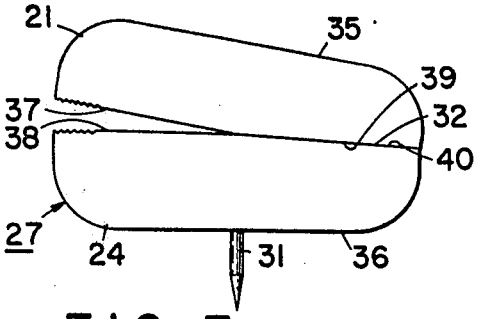
FIG. 7 is a side view showing the safety pushpin of FIGS. 4 to 6 in use.

On the side of the slanting faces 39, 40 is provided a spring 34 which is V-shaped in side view and compressedly interposed between an inside stepped portion 44 in the upper shell and a detent 45 provided on the bottom face 25 of the lower shell. Said spring 34 is adapted to let the parallel faces 37 and 38 elastically press against each other so that these faces may elastically hold therebetween paper or the like when the device is used as a clip. It is desirable to provide a non-skid knurl or tooth-like unevenness on said parallel faces 37 and 38 to ensure secure gripping by said faces 37 and 38. It is also desirable to mount between the head 29 of the pushpin 28 and the bottom wall 25 of the lower shell 24 a suitable elastic body such as a coil spring 46 or urethane foam as shown in FIGS. 4 to 6 so as to always give an upward force to the pushpin 28 so that the head 29 of the pushpin 28 is normally kept in pressed abutment against the underside of the inward flange 22 of the upper shell 21.

Figure 8:
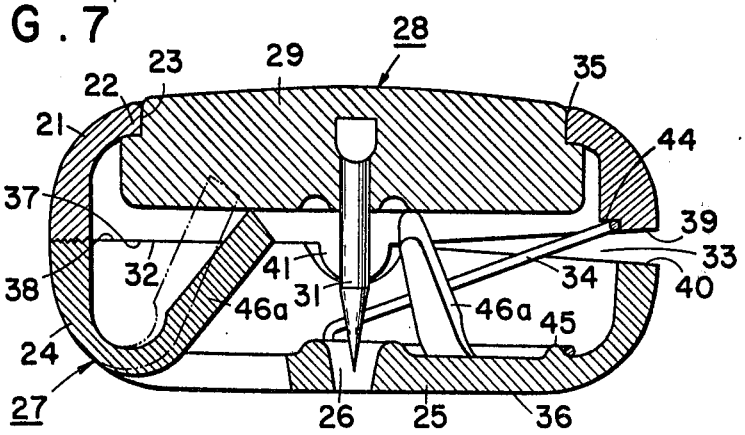
FIG. 8 is a central longitudinal sectional side view showing a modification of the safety pushpin shown in FIGS. 4 to 7.

Said upward force given to the pushpin 28 may be also provided by forming the lower shell 24 from an elastic material such as plastic while cutting and raising up a suitable part or parts in the bottom wall 25 to form an elastic flap of flaps 46*a* as shown in FIG. 8 so that the end or ends thereof pressingly abut against the underside of the head 29 of the pushpin 28 to produce the same elastic action as a coil spring. It is to be noted that said upward force given to the pushpin should of course be such that it exerts no influence to the tacking-down action of the pushpin during use thereof.

In use of the safety pushpin shown in FIGS. 4 to 8, a finger or the like is inserted into the large-diameter hole 23 in the casing 27 and then pushes down the head 29 of the pushpin 28 to run the pin 31 into a desired spot to use the device as a normal pushpin. In this tacked state, if desired, the oblique space 33 may be closed while opening the parallel faces 37 and 38 to clip paper or the like. It is also possible to first clip paper or the like and then tack down the pushpin to a desired place.

In still another embodiment of the present invention, a permanent magnet 47 may be provided on the bottom face 25 of the casing 27 so that the device according to the present invention, when used as a clip, can be held fast to a magnetic material such as iron plate into which the pin 31 can not be thrust.

It will be apparent that the safety against injuries to the body of a person or damages to other things in non-use of the device according to the present invention is assured as perfectly as the pushpin of the embodiment shown in FIGS. 1 to 3.

What is claimed is:

1. A safety pushpin that can concurrently serve as a clip, comprising, a head and pin extending from the central part of said head, said pushpin being housed within a casing comprising an upper shell having a shell top with a large-diameter hole surrounded by an inwardly extending flange and a lower shell having a bottom wall with a small-diameter hole in the center thereof; said head being larger in diameter than the distance across said flange of said large-diameter hole and said pin being passable through said small-diameter hole in the bottom wall of said lower shell, and further characterized in that an oblique space spread out radially toward both upper and lower ends is provided at a suitable part in the juncture of said upper and lower shells, both of said upper and lower shells being joined together swingable relative to each other so that said oblique space may be closed, and an elastic material is provided between said upper and lower shells to normally keep said oblique space open.

2. The safety pushpin as set forth in claim 1, wherein a suitable weak elastic means is interposed between the head of the pushpin and the bottom wall of said lower shell to push up said head so that the upper side thereof is pressed against and checked by the underside of the inwardly flanged edge of said large-diameter hole.

3. The safety pushpin as set forth in claim 1, wherein said lower shell is made from an elastic material and a suitable part or parts of the bottom wall is/are cut and raised up to form an elastic flap or flaps to give an elastic action to the head of the pushpin.

4. The safety pushpin as set forth in claim 2, wherein said elastic means is a coil spring.

5. The safety pushpin as set forth in claim 2, wherein said elastic means is urethane foam.

6. The safety pushpin as set forth in claim 1, wherein a permanent magnet is provided at the bottom of said lower shell.

7. The safety pushpin as set forth in claim 1, wherein a non-skid means is provided at the parallel faces in the juncture of said upper and lower shells.

8. A safety pushpin comprising, a head having a top and an underside;

a pin having an upper end secured to said underside of said head and a lower pointed end;

a casing having a cavity therein for housing said pin and said head, said casing having a large diameter hole in the top thereof and a small diameter hole in the bottom thereof;

an annular inwardly extending flange extending around said large diameter hole, said pin and head being within said cavity with said top of said head being presented towards said annular flange and with said pointed end of said pin in registered alignment with said small diameter hole, said head being sized larger than said annular flange so that said annular flange will limit upward movement of said head at an upper position wherein said upper surface of said head is substantially co-planar with said top of said casing, an elastic body within said cavity for engaging said head and yieldably urging said head into engagement with said annular rim, said head being exposed to the exterior of said casing through said large diameter hole whereby said head can be manually pressed downwardly within said casing to a position wherein said pointed end of said pin protrudes through said small diameter hole, said casing being formed from shells which are split vertically.

9. A safety pushpin comprising, a head having a top and an underside;

a pin having an upper end secured to said underside of said head and a lower pointed end;

a casing having a cavity therein for housing said pin and said head, said casing having a large diameter hole in the top thereof and a small diameter hole in the bottom thereof;

an annular inwardly extending flange extending around said large diameter hole, said pin and head being within said cavity with said top of said head being presented towards said annular flange and with said pointed end of said pin in registered alignment with said small diameter hole, said head being sized larger than said annular flange so that said annular flange will limit upward movement of said head at the upper position wherein said upper surface of said head is substantially co-planar with said top of said casing, an elastic body within said cavity for engaging said head and yieldably urging said head into engagement with said annular rim, said head being exposed to the exterior of said casing through said large diameter hole whereby said head can be manually pressed downwardly within said casing to a position wherein said pointed end of said pin protrudes through said small diameter hole, said elastic body being urethane foam.

* * * * *